United States Patent [19]

Prelich

[11] Patent Number: 5,014,981

[45] Date of Patent: May 14, 1991

[54] EXERCISING DEVICES USING MAGNETIC RESISTANCE

[76] Inventor: John G. Prelich, 200 Onyx Ave., Apt. 2, Pittsburgh, Pa. 15210

[21] Appl. No.: 917,844

[22] Filed: Oct. 14, 1986

[51] Int. Cl.[5] ..... A63B 21/072

[52] U.S. Cl. ..... 272/122; 272/129

[58] Field of Search ..... 272/123, 118, 117, 122, 272/134, DIG. 4, 129; 446/129

[56] References Cited

U.S. PATENT DOCUMENTS

| | | | |
|---|---|---|---|
| 272,144 | 2/1883 | McGinnis | 272/122 X |
| 4,462,596 | 7/1984 | Yamamoto | 446/129 |
| 4,623,146 | 11/1986 | Jackson | 272/123 X |

FOREIGN PATENT DOCUMENTS

| | | | |
|---|---|---|---|
| 176962 | 4/1986 | European Pat. Off. | 272/129 |
| 225914 | 8/1985 | German Democratic Rep. | 272/129 |
| 469457 | 5/1975 | U.S.S.R. | 272/129 |
| 952278 | 8/1982 | U.S.S.R. | 272/129 |

*Primary Examiner*—Richard E. Chilcot, Jr.
*Attorney, Agent, or Firm*—William J. Ruano

[57] ABSTRACT

An exercising apparatus comprising a pair of permanent magnets, each preferably surrounded by a container or glove for safety. A second pair of magnets may be worn, such as on a belt for interaction with said first pair. The magnets may be combined with dumbbells or barbells to interract with a second pair of stationary or movable magnets wherein resistance is provided by repulsion of like poles or attraction of unlike poles. They may be at right angles or parallel to dumbbells. Pairs of magnets may be guided by flexible or rigid tracks and may be cylindrically shaped so as to be reciprocable in a cylinder by grips projecting outwardly of the ends of the cylinder. Springs may oppose movement of guided magnets.

10 Claims, 2 Drawing Sheets

EXERCISING DEVICES USING MAGNETIC RESISTANCE

This invention relates to exercising devices using magnetic repulsion or attraction for resistance, which I refer to by the service mark "Magnaflex" system.

BACKGROUND OF THE INVENTION

Perhaps the two most intense and ongoing debates in the field of muscle strength and size developmental training are: (1) isometric vs. isotonic contraction, and, (2) free weight vs. machine isotonic contraction.

Isometric (contraction without movement) exercise will produce the most strength increase with the shortest training time. However, the strength increase is specific for a very short and limited span within the full potential range of the muscle.

Obviously, such a strength increase is of little practical value in sports or other activities. If the muscle is isometrically exercised at many positions throughout its range of motion, this limitation can be circumvented. However, isometric exercise shuts off the blood supply to the muscle. Therefore, isometrically developed strength is not accompanied by increased muscle capillarization, increased local anaerobic endurance, or with maximum muscle size increases. All of these additional benefits are normally associated with intense isotonic strength training. Also, isometric exercise does not promote the development of increased muscle flexibility (and the subsequent reduced risk of sports injury) since the muscle is not worked over its full range of motion. Since the resistance utilized is isometric training is immobile, increased muscle coordination and control is also unaffected.

In addition to increased strength, all of these additional benefits are provided by both free weights and machine isotonic strength training except for increased muscle coordination and control. This benefit is provided only by the free weights, because balance and control are required for their use as opposed to machines containing weights or other resistance restricted to an exact limited plane of motion. This "limitation" does, however, produce safety from the dangers of falling weights.

Many machine weight systems intentionally allow a much greater isolation of individual muscles as opposed to free weights or some other machines. Although this may be of great benefit in certain extremely specific instances such as injury rehabilitation training, or for a top level bodybuilder trying to provide extra work to only certain slower growing muscles, the other claimed advantages are dubious as best. In fact, in the "real world" of everyday activities and sports, muscles almost always work together as large groups. Potential overdevelopment of a specific muscle by isolation training may hinder useful interactions within the group.

Some machines have systems of cams, levers, etc., which allow the exercising muscles to experience constant resistance throughout the full range of motion of the exercise. This should allow for more muscle fibers to be stimulated. Free weights provide varying resistance throughout the movement as the mechanical advantage is greater at some points in the motion than in others. For example, in the fundamental weight training exercise, known as the bench press, the movement begins with the subject prone on a bench with a barbell positioned on the chest. The weight is pushed upwardly until the arms are fully extended with the elbows locked in a completely unbent position above the chest.

Due to the change in mechanical advantages, the same weight provides much more resistance at, for example, a position halfway between the bottom and top as opposed to a position 9/10 of the way from the bottom and thus with the arms almost straight. Although the bench press utilizes chiefly the chest, shoulder, and tricep muscles, the individual muscle fibers used are not all the same at the 1/10, 5/10, and 9/10 positions. Some fibers potentially used at the 8/10 and 9/10 positions will never be used or developed because the resistance is insufficient to require their use. If enough weight was provided to provide sufficient development for these fibers, the subject exercising would never be able to move the bar off of the chest.

A modified bench press on certain machines will provide equal resistance at all positions. However, the loss of a need to balance or control the weight can detract from the "real world" usefulness of the strength developed.

SUMMARY OF THE INVENTION

Exercising devices using magnetic resistance exerted by permanent magnets, either in pushing like poles together, or unlike poles apart are described herein. The magnets are preferably enclosed in a container or glove to prevent injury from accidental coming together of the magnets. The magnets may supplement weight lifting and similar exercises, or may be used alone. Various modifications are shown for different exercises. In some instances, electromagnets may be used instead.

DETAILED DESCRIPTION OF THE PREFERRED EMBODIMENT

Referring more particularly to the drawings, FIG. 1 is an elevational view which shows magnets used in a barbell;

FIGS. 2*a* and 2*b* are elevational views showing magnets used alone and lifted sidewise of the exerciser;

FIG. 3 is an elevational view showing magnets added to dumbbells; FIG. 3*b* is a cross-section and FIG. 3*c* is a modification.

FIG. 3*a* is an elevational view showing the specific construction of magnetic dumbbells;

FIG. 4 is an elevational view showing permanent magnets with box type protective shields;

FIG. 5*a* is an elevational view showing permanent magnets enclosed by gloves;

FIG. 5*b* is an elevational view showing permanent magnets contained in a wrist wrap shield;

Figure 1:
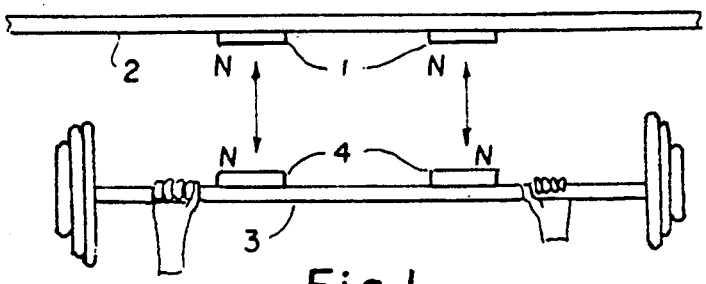

The system of the present invention is shown in FIG. 1 as fully demagnetization resistant magnets 1 attached to a permanent or stationary horizontal bar 2 just above the position of the barbell 3 at the completion of a bench press. Attached to the barbell 3 are similar magnets 4 whose upper faces are of the same polarity as the downward face of the fixed upper magnets. As the barbell approaches the completion of the movement, the resistance would normally be reduced to only a portion of its maximum. With the system just described, the repulsion will now be very great during the last phase of the lift. However, unlike the machine bench press systems, the resistance must still be controlled and balanced for optimum development of truly "useful" strength. In fact, due to the instability of magnetic repulsion, the development of a coordinated strength with a balance and control (most useful for athletics and feats of power) would be greater than with free weights alone.

Figure 2A:
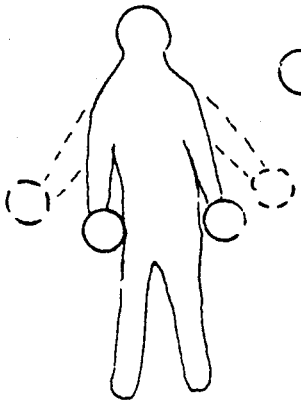
Figure 2B:
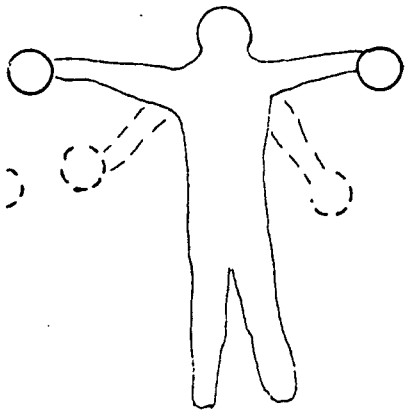

Magnetic attraction can also be used to augment and perfect conventional weight training:

In the free weight exercise known as lateral shoulder raises (shown in FIGS. 2*a* and 2*b*), two dumbbells are held at the hips or sides of the thighs with the arms hanging down straight as shown in FIG. 2*a*. The, with arms locked or nearly locked at the elbows, the dumbbells are raised until they are above the parallel to the floor position as shown in FIG. 2*b*. During the first portion of the rise, resistance is minimal.

Figure 2C:
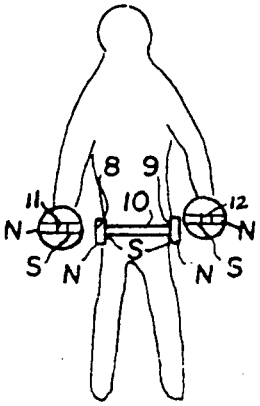

FIG. 2*c* shown a system wherein magnets 8 and 9 could be attached to the sides of the hips or legs such as by a belt 10 and onto the dumbbells. With the opposite poles 11 and 12 of each pair of magnets facing each other, resistance at the initiation of the lateral raise is now very great.

Figure 3A:
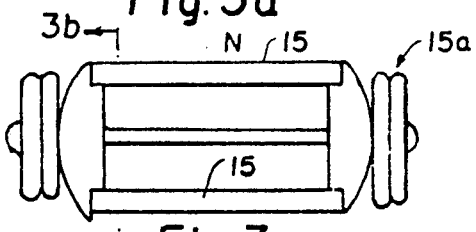
Figure 3:
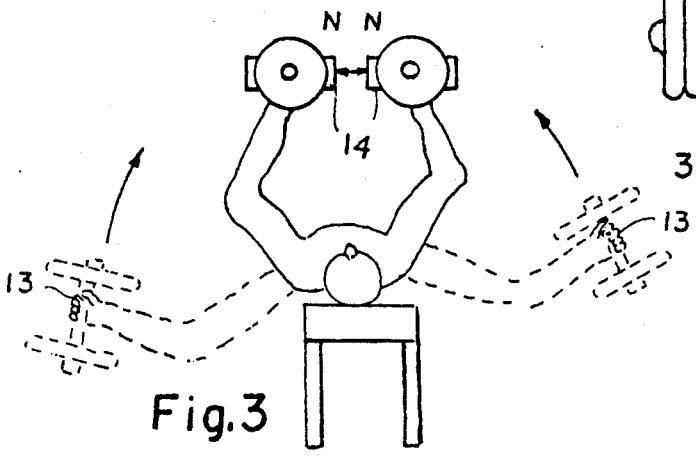
Figure 3B:
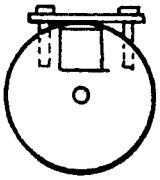
Figure 3C:
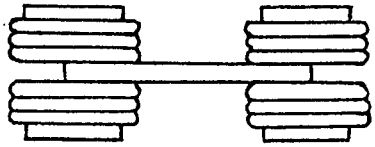

FIG. 3 shows another example of a free weight exercise using the present invention which is a variation of the dumbbell "fly" exercise. While lying in the prone position, dumbbells 14 and 15 are raised from below bench level to a top position with the dumbbells almost touching. The arms are locked at all times in a nearly unbelt elbow position. Near the completion of the movement, resistance is almost nonexistant. However, if the dumbbells contain magnets 15,15 with like poles facing each other, resistance near the completion of the movement is now very great. The magnets are preferably flat rectangular magnetic plates 15 with flat weight plate 15*a* at right angles as shown in FIGS. 3*a*–3*b* or parallel as shown in FIG. 3*c*.

All of these examples demonstrate how the system of the present invention can allow the advantages of "free" weights to coexist with maximum muscle fiber recruitment over a wide range of the exerciser's motion.

An essential component of the present invention is the use of demagnetization resistance magnets. Many magnets will lose magnetism rapidly if employed in a repulsive manner by facing the like poles against each other. Fully oriented barium ferrite ceramic magnets lose very little magnetism in such situations and are an essential component of the present invention.

Employing magnets in a repulsive manner to provide resistance for muscular exercise results in an unstable multidimensional direction of resistance. The like poles are directly pushing away from each other, but at the same time, the like poles are attempting to come together. Therefore, the magnets are difficult to control, almost as if they were vibrating. Unfortunately, the user's hands or fingers can easily be smashed by the magnets suddenly coming together.

Figure 4:
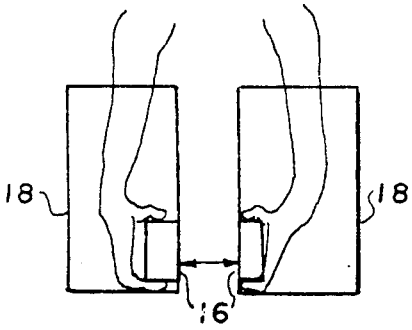
Figure 5A:
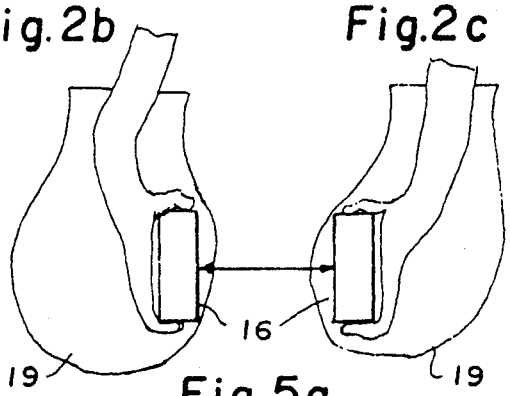
Figure 5B:
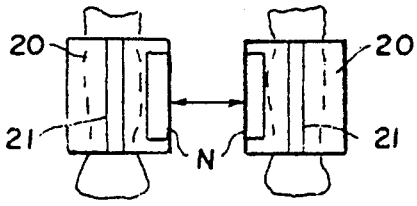

Therefore, as shown in FIGS. 4, 5*a*, and 5*b*, an essential component is the use of shields to guard the hands and fingers. Box shields 18 (FIG. 4) and glove shields 19 (FIG. 5*a*) are the two basic types of shields used with hand held magnets 16. FIG. 5*b* shows wrist wrapped shields 20 of leather or vinyl held together at opposite edges by "Velcro" hook and pile fasteners 21.

Figure 6:
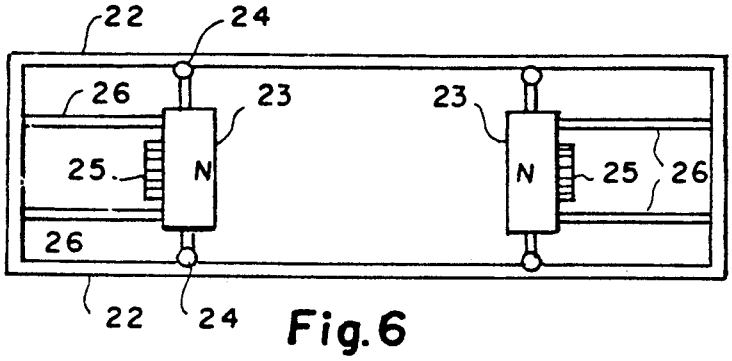
FIG. 6 is a top view showing permanent magnets guided in an exercising machine.

FIG. 6 is a top view of a modification for guiding the magnets as they are moved. Such guide may be in the form of a rectangular frame 22, which is either rigid or flexible, for guiding the magnets 23,23 by means of rollers 24,24 which roll on the tracks 22,22 or, which may be even linked thereto by holes made in rollers 24,24 through which the tracks 22,22 extend. Such flexible tracks prevent total control. Handles 25,25 are attached to the outside of the magnets, which magnets are attached to the ends of springs 26,26.

In operation, as the handles 25,25 are pushed together, they will be initially resisted by the tension of springs 26,26, but as the like poles of the magnets approach each other, their repulsion will provide additional resistance which increases as the poles come closer together.

Figure 7:
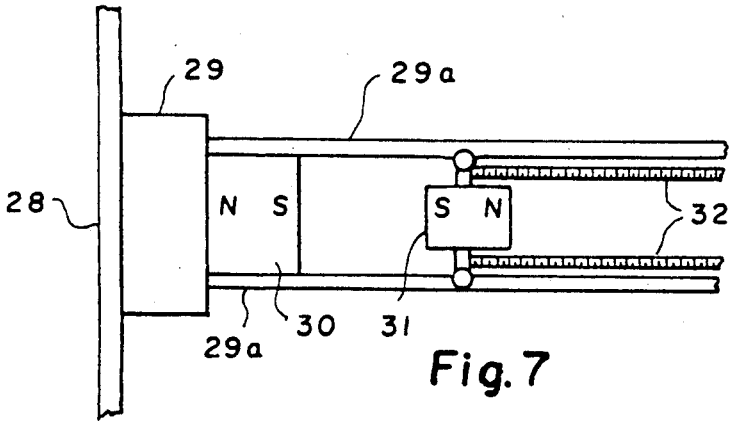
FIG. 7 is a top view of a modification of the machine shown in FIG. 6.

FIG. 7 is a modification of FIG. 6 in which a wall 28 has rigidly connected thereto a support frame 29 attached to either a rigid track or a flexible track or cables 29*a*, 29*a* which guide the movements of a magnet 31 attached to the end of springs 32 whose opposite ends are rigidly connected to a stationary frame (not shown). A rigid magnet 30, of the same polarity as the confronting magnet 31, is attached to stationary support 29.

In operation, as the feet are placed against the pole indicated "N" of magnet 31, the magnet is pushed toward magnet 30 against the resistance of spring 32, and upon approaching magnet 30, progressively increased magnetic resistance is added thereto.

Figure 8:
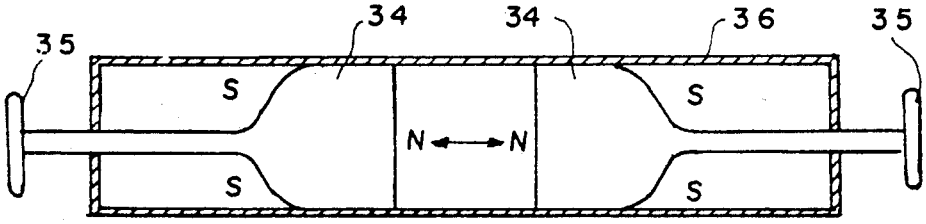
FIG. 8 is an elevational view of a one-way system showing piston-like magnets in a cylindrical tube.

FIG. 8 shows a modification wherein magnets 34,34 are in the form of pistons having stems at the ends of which are rigidly secured handles 35,35 to enable reciprocation of the postons in cylinder 36. As the pistons are pushed closer together, magnetic resistance is increased. If desired, springs (not shown) may be inserted between the south pole and the ends of the cylinder to give increased resistance when the handles are pushed together when too distant for magnetic repulsion.

Figure 9:
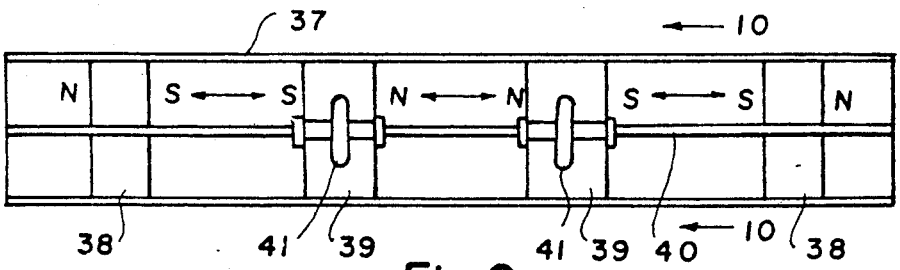
FIG. 9 is an elevational view of a two-way system showing a plurality of cylindrical magnets.
Figure 10:
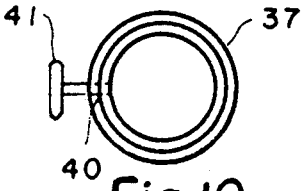
FIG. 10 is a sectional view taken along line 10—10 of FIG. 9.

FIGS. 9 and 10 show a two-way system including a cylinder 37 in which a pair of fixed magnets 38,38 are held stationary in the piston while two movable magnets 39,39 are moved toward the fixed magnets 38,38 by means of handles 41 rigidly connected through a slit 40, to the movable magnets 39,39 as shown in FIG. 10.

By moving the handles 41 toward the center of the tube or cylinder 37, the "pushing" muscles of the upper body are exercised. By moving the handles toward the end of the cylinder, the "pulling" muscles of the upper body are exercised. The handles may be either attached as shown or at right angles thereto by moving the slit 40 through an angle of 90°.

The lack of control in the present invention is most beneficial in recruiting new muscle fibers, thus preventing muscle growth stagnation. In fact, it has been reported that some top level bodybuilders, weight lifters, and other strength athletes like to work as lumberjacks for at least a few weeks every year if possible. They report new and extensive muscle development in the wrists and forearms.

The present invention provides similar "limited control" muscle resistance, but extends the workout to more muscle groups than just the wrists or forearms. Also, it produces none of the noise or tissue damaging shock and vibration of power saws, jackhammers, etc.

One of the fundamental principles of exercise physiology is that when a muscle performs work, the muscle fibers involved are "recruited" by the nervous system in the most efficient sequential manner. So-called slow twitch muscle fibers are very energy efficient, but are not capable of producing fast, powerful contractions. So-called fast twitch muscle fibers are capable of producing fast, powerful contractions, but are easily fatigued. Therefore, slow twitch fibers are recruited first. When more force is required, fibers intermediate between fast and slow twitch are recruited. Only when the resistance increases further, or when the previously recruited fibers are to fatigued to produce sufficient force, are the fast twitch fibers recruited. These fibers will soon be exhausted. During beginning and intermediate training, sequential induction can produce training progress. However, the unchanging sequential fiber recruitment is one factor that leads to eventual training stagnation, as progress slows or stops. The constant need to control the unstable magnets prevents orderly fiber recruitment and thus also prevents training stagnation. Progress is always possible if the body is presented with unpredictable but gradually increasing training stress. The present invention can provide this.

"Intent" of muscles is isometric, but the need to control the magnets and constant muscular contraction adjustments makes it isotonic with blood flow. Perfect sequention muscle type (fast or slow twitch) recruitment is impossible due to unpredictability of the resistance, so full adaption and training stagnation is much less likely. Also, it produces very coordinated controlled strength for sports.

The following are some major essentials of the present invention which I refer to by the service mark "Magnaflex" system:

1. Demagnetization resistant magnets such as barium ferrite ceramic or rare earth alloy materials.
2. Shields to protect hands from out-of-control magnets.
3. Resistance at points of motion where gravity provides little or none (such as near the top of dumbell flys). The majority of conventional free weight exercises can be greatly improved by the appropriate addition of magnetic repulsion and or attraction. This list provides only a few examples of this fundamental "Magnaflex" principle.
4. Using a variable number of magnet plates.
5. Adding adjustable extra weight or springs.
6. Using variable thickness magnet "covers" to reduce resistance, if required. As the user becomes stronger, he can reduce the number of covers until zero, then add another magnet.
7. In addition to fitness training for healthy individuals, the need to control the magnets could provide great benefits to recovering victims of temporary paralysis. As a rehabilitative tool, the system of the present invention can be used to help patients regain both strength and neuromuscular control and coordination.
8. Limited controllability must be maintained otherwise, results will be no better than with other forms of resistance such as weights, springs, pulleys, etc.

Thus it will be seen that I have provided a highly improved exerciser employing permanent magnets which, in some instances, may be electromagnets and wherein reliance is made on magnetic attraction or repulsion of unlike or like poles, thereof, respectively.

While I have illustrated and described several embodiments of my invention, it will be understood that these are by way of illustration only and that various changes and modifications may be contemplated in my invention and within the scope of the following claims.

I claim:

1. An exerciser comprising a pair of magnets capable of being aligned so that like poles are in confronting relationship so as to produce magnetic repulsion, protective means surrounding each magnet comprising a box surrounding each hand, having an opening on one side.

2. An exerciser comprising a pair of magnets capable of being aligned so that like poles are in confronting relationship so as to produce magnetic repulsion, protective means surrounding each magnet, said protective means being a padded glove.

3. An exerciser comprising a pair of magnets capable of being aligned so that like poles are in confronting relationship so as to produce magnetic repulsion, a second pair of magnets, one of said pair of magnets having attaching means for wear on a belt to be worn by a person.

4. An exerciser comprising a pair of magnets capable of being aligned so that like poles are in confronting relationship so as to produce magnetic repulsion, a dumbbell attached to each magnet, said dumbbell being at right angles to said magnet.

5. An exerciser comprising a pair of magnets capable of being aligned so that like poles are in confronting relationship so as to produce magnetic repulsion, a second pair of magnets, a barbell including a hand gripping rod to which a plurality of said magnets is attached, said plurality of magnets being mounted so as to provide facing poles of the same polarity, half being attached to a ceiling.

6. An exerciser comprising a pair of magnets capable of being aligned so that like poles are in confronting relationship so as to produce magnetic repulsion, means for guiding said magnets in a direction towards each other together with the spring means for resisting movement of said magnets toward each other.

7. An exerciser comprising a pair of magnets capable of being aligned so that like poles are in confronting relationship so as to produce magnetic repulsion, means for guiding said magnets in a direction towards each other together with the spring means for resisting movement of said magnets toward each other and a hand grip attached to each magnet, said guiding means comprising rigid track means.

8. An exerciser comprising a pair of magnets capable of being aligned so that like poles are in confronting relationship so as to produce magnetic repulsion, means for guiding said magnets in a direction towards each other, said means being a cylinder, said magnets being cylindrical in shape, and a handle attached to the outer end of each magnet and projecting outwardly on the end of said cylinder.

9. An exerciser comprising a pair of magnets capable of being aligned so that like poles are in confronting relationship so as to produce magnetic repulsion, means for guiding said magnets in a direction towards each other, said means being a cylinder and wherein a plurality of pairs of said magnets are contained within said cylinder and are of cylindrical shape closely fitted to said cylinder, a pair of said magnets having handles attached thereto.

10. An exerciser comprising a pair of magnets capable of being aligned so that like poles are in confronting relationship so as to produce magnetic repulsion, a dumbbell attached to each magnet, said dumbbell being at right angles to said magnet, opposing notches being formed in said dumbbell in which the ends of said magnet are inserted.

* * * * *